US008779665B2

(12) United States Patent
Oh et al.

(10) Patent No.: US 8,779,665 B2
(45) Date of Patent: Jul. 15, 2014

(54) BACKLIGHT UNITS AND CURRENT CONTROL METHODS THEREOF

(75) Inventors: Won Sik Oh, Seoul (KR); Youngsup Kwon, Gwangmyeong-si (KR); Jaekyu Park, Asan-si (KR); Eun Chul Shin, Cheonan-si (KR); Jaeeun Um, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 180 days.

(21) Appl. No.: 13/313,198

(22) Filed: Dec. 7, 2011

(65) Prior Publication Data

US 2013/0026926 A1 Jan. 31, 2013

(30) Foreign Application Priority Data

Jul. 26, 2011 (KR) ..... 10-2011-0073949

(51) Int. Cl.
*H05B 37/02* (2006.01)

(52) U.S. Cl.
USPC ..... 315/151; 315/185 R; 315/297; 315/307

(58) Field of Classification Search
USPC ..... 315/119, 121, 122, 123, 185 R, 192, 315/291, 294, 295, 297, 299–301, 307
See application file for complete search history.

(56) References Cited

U.S. PATENT DOCUMENTS

| | | | | |
|---|---|---|---|---|
| 6,515,434 | B1 * | 2/2003 | Biebl | 315/291 |
| 6,563,849 | B2 | 5/2003 | Mizuno | |
| 6,864,641 | B2 * | 3/2005 | Dygert | 315/216 |
| 7,605,809 | B2 | 10/2009 | Wey et al. | |
| 7,919,936 | B2 * | 4/2011 | Liu et al. | 315/307 |
| 7,999,487 | B2 * | 8/2011 | Szczeszynski | 315/291 |
| 2010/0060190 | A1 | 3/2010 | Cheng | |
| 2011/0012521 | A1 | 1/2011 | Byun et al. | |

FOREIGN PATENT DOCUMENTS

| | | | |
|---|---|---|---|
| JP | 2009-016685 | A | 1/2009 |
| JP | 2010-067673 | A | 3/2010 |

* cited by examiner

*Primary Examiner* — James H Cho
(74) *Attorney, Agent, or Firm* — Cantor Colburn LLP

(57) ABSTRACT

A backlight unit including: at least one light emitting diode ("LED") string having an anode, which receives a string current, and a chassis-grounded cathode; and a current source control unit which receives a driving current and outputs the string current to the at least one LED string, where the current source control unit senses the driving current and compensates for the string current based on the sensed driving current and a reference voltage.

19 Claims, 11 Drawing Sheets

BACKLIGHT UNITS AND CURRENT CONTROL METHODS THEREOF

This application claims priority to Korean Patent Application No. 10-2011-0073949, filed on Jul. 26, 2011, and all the benefits accruing therefrom under 35 U.S.C. §119, the content of which in its entirety is hereby incorporated by reference.

BACKGROUND OF THE INVENTION

Exemplary embodiments of the invention relate to a backlight unit and a current control method thereof.

Generally, liquid crystal display ("LCD") devices include a liquid crystal panel that displays an image, and a backlight unit disposed under the liquid crystal panel to supply light to the liquid crystal panel. When light emitting diodes ("LED"s) are used as a light source of the backlight unit, the backlight unit typically includes a plurality of light source strings that are connected to each other in parallel, a direct current to direct current ("DC" to "DC") converter for supplying a driving voltage to the light source strings, and a driver integrated circuit ("IC") connected to the light source strings through a plurality of channels. Typically, each light source string includes a plurality of serially-connected LEDs.

BRIEF SUMMARY OF THE INVENTION

Exemplary embodiments of the invention provide a backlight unit and a current control method thereof, which effectively prevent heat generation or ignition when a light emitting diode ("LED") string is shorted.

An exemplary embodiment of the invention provides a backlight unit including: at least one LED string having an anode, which receives a string current, and a chassis-grounded cathode; and a current source control unit which receives a driving current and outputs the string current to the at least one LED string, where the current source control unit senses the driving current and compensates for the string current based on the sensed driving current and a reference voltage.

In an exemplary embodiment, the reference voltage may correspond to luminance of light emitted from the at least one LED string.

In an exemplary embodiment, the current source control unit may include: a current feedback unit connected between a first node and a second node, and which receives a DC voltage from the first node to output a driving voltage to the second node and outputs the input driving current to the second node; a current compensator which senses the driving current flowing in the current feedback unit and compares the sensed driving current and the reference voltage to output current compensation information; and a current regulator connected between the second node and the anode, and which receives the driving voltage and the driving current to output the string current and compensates for the string current based on of the current compensation information.

In an exemplary embodiment, the current feedback unit may include a sensing resistor between the first and second nodes, and the current compensator may sense a voltage difference between a voltage of the first node and a voltage of the second node to sense the driving current flowing in the sensing resistor.

In an exemplary embodiment, the current feedback unit may include: a photodiode between the first node and the second node and which emits light; and a photocoupler including a transistor which is turned on based on the light emitted from the photodiode, where the light emitted from the photodiode corresponds to the driving current.

In an exemplary embodiment, the current source unit may include: an operational amplifier which receives the reference voltage and a voltage corresponding to the driving current to output a voltage corresponding to the current compensation information; a current compensation transistor which is turned on based on the voltage corresponding to the current compensation information; and a current regulator having a current mirror structure, where the current regulator outputs the string current in response to a current flowing in the current compensation transistor.

In an exemplary embodiment, the backlight unit may further include a voltage detector which detects a driving voltage and a string voltage of the anode to output a feedback voltage, where the driving voltage corresponds to the string voltage.

In an exemplary embodiment, a voltage difference between the driving voltage and the string voltage may be maintained to be less than a predetermined value.

In an exemplary embodiment, the driving current supplied to the at least one LED string may be blocked when a voltage difference between the driving voltage and the string voltage is equal to or greater than a predetermined value.

In an exemplary embodiment, the backlight unit may further include a DC-to-DC converter which boosts an input source voltage to output a DC voltage and controls the DC voltage based on the feedback voltage, where the DC voltage corresponds to the driving voltage.

In an exemplary embodiment, a voltage difference between the DC voltage and the driving voltage may be about 0.1 volt (V) to about 0.5 volt (V).

In an exemplary embodiment, the DC to DC converter may include an inductor booster which boosts the source voltage to the DC voltage.

In an exemplary embodiment, the current source control unit may compensate for the string current when light is emitted from the at least one LED string.

In an alternative exemplary embodiment the invention, a backlight unit include: a plurality of LED strings having an anode, which receives a string current, and a chassis-grounded cathode; a DC-to-DC converter which boosts a source voltage to output a DC voltage; a current feedback unit which receives the DC voltage to output a plurality of driving voltages and outputs a plurality of driving currents corresponding to the LED strings, respectively; a current regulator which receives the driving voltages and the driving currents and outputs a plurality of string currents respectively flowing in the LED strings based on of current control information; and an LED driving controller which senses the driving currents flowing in the current feedback unit to output the current control information to compensate for the string currents and controls the DC voltage based on relationships between the driving voltages and the string voltages, where the string voltages are voltages at anodes of the LED strings, respectively.

In an exemplary embodiment, the LED driving controller may be configured as an integrated circuit ("IC").

In an exemplary embodiment, the IC may include: a plurality of current source control units which senses the driving currents to output current compensation information for controlling the string currents; a maximum value circuit which detects a maximum value among the string voltages and the driving voltage; and an output voltage control unit which receives an output of the maximum value circuit to output a feedback voltage.

In an exemplary embodiment, each of the current source control units may include: a first operational amplifier which outputs a voltage corresponding to a voltage difference between the DC voltage and the driving voltage; a second operational amplifier which outputs a voltage corresponding to a voltage difference between the output value of the first operational amplifier and a reference voltage; a third operational amplifier which outputs a voltage corresponding to a voltage difference between a divided voltage corresponding to the DC voltage and the string voltage; and a current balance control unit which outputs the reference voltage in response to a pulse width modulation signal.

In an exemplary embodiment, the current feedback unit may include a plurality of sensing resistors, in which the driving currents flow.

In an exemplary embodiment, the current regulator may include a plurality of metal-oxide-semiconductor ("MOS") transistors having a gate which receives the current control information, where the MOS transistors receive the driving currents to output the string currents.

In another exemplary embodiment of the invention, a current control method of a backlight unit include: sensing a driving current flowing in a hot side of each of a plurality of LED strings; compensating for the driving current based on of the sensed driving current and a reference voltage; and regulating a plurality of string currents respectively flowing in the LED strings based on the compensated driving current, where cathodes of the LED strings are chassis-grounded.

BRIEF DESCRIPTION OF THE DRAWINGS

The above and other aspects and features of the invention will become readily apparent by reference to the following detailed description when considered in conjunction with the accompanying drawings, in which.

DETAILED DESCRIPTION OF THE INVENTION

Figure 1:
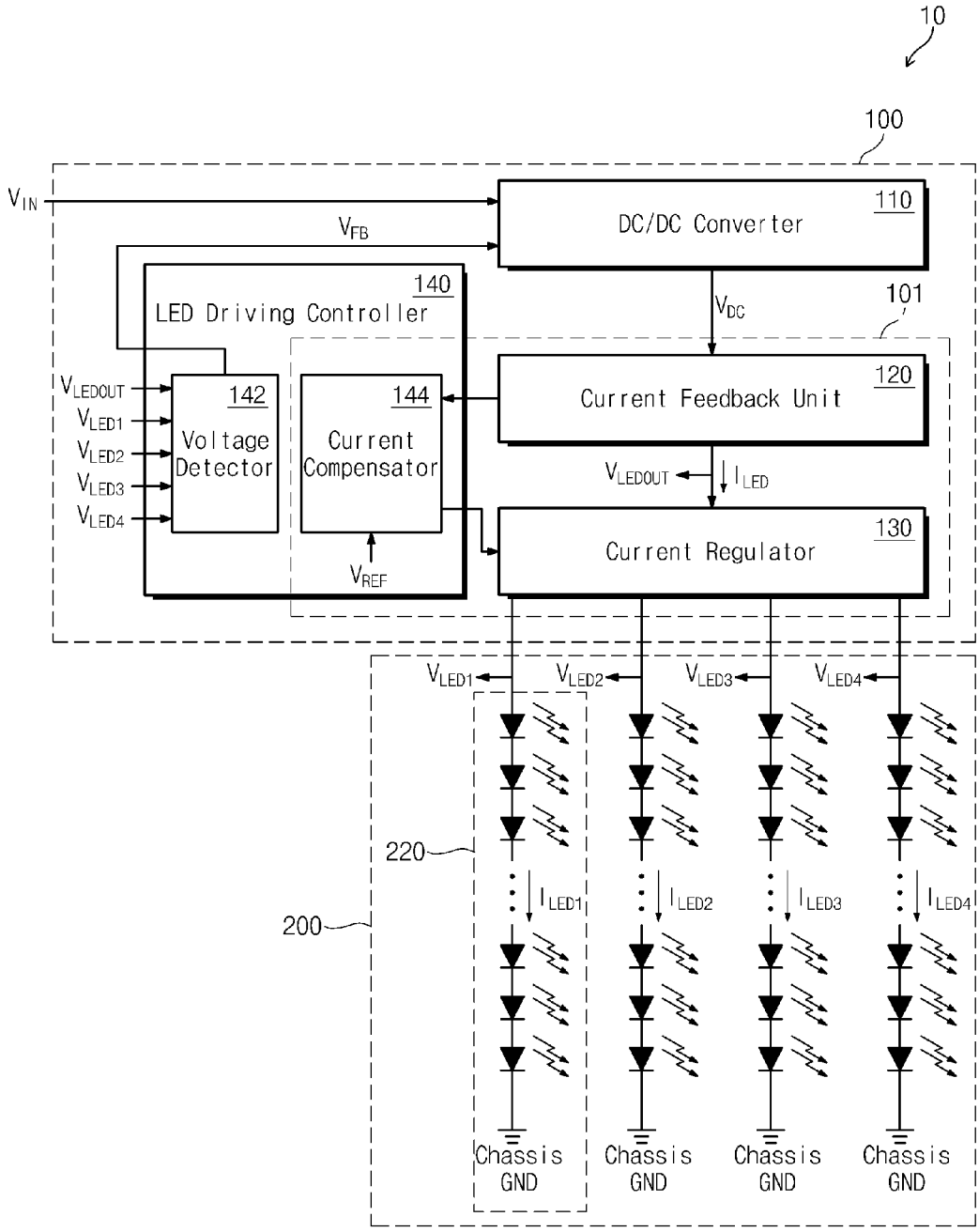
FIG. 1 is a block diagram illustrating an exemplary embodiment of a backlight unit according to the invention.

It will be understood that when an element or layer is referred to as being "on" or "connected to" another element or layer, it can be directly on or connected to the other element or layer or intervening elements or layers may be present. In contrast, when an element is referred to as being "directly on" or "directly connected to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "below," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "lower" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a," "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the invention will be explained in detail with reference to the accompanying drawings.

FIG. 1 is a block diagram illustrating an exemplary embodiment of a backlight unit according to the invention.

Referring to FIG. 1, the backlight unit 10 includes an light emitting diode ("LED") driving circuit 100 and at least one LED string 200 (also referred to as an "LED array").

The LED driving circuit 100 receives a source voltage $V_{IN}$ to drive the at least one LED string 200. The LED driving circuit 100 includes a direct-current-to-direct-current ("DC"- to-"DC") converter 110, a current feedback unit 120, a current regulator 130 and an LED driving controller 140.

The DC-to-DC converter 110 boosts the source voltage $V_{IN}$ to generate a DC voltage $V_{DC}$, and regulates the DC voltage $V_{DC}$ with a feedback voltage $V_{FB}$. In an exemplary embodiment, the feedback voltage $V_{FB}$ is a voltage based on a relationship between a driving voltage $V_{LEDOUT}$ and a plurality of string voltages $V_{LED1}$ to $V_{LED4}$.

The current feedback unit 120 outputs a driving current $I_{LED}$ and the driving voltage $V_{LEDOUT}$ corresponding to the DC voltage $V_{ic}$. In an exemplary embodiment, the driving current $I_{LED}$ may be a total current for driving the at least one LED string 200. In such an embodiment, a voltage difference between the driving voltage $V_{LEDOUT}$ and the DC voltage $V_{DC}$ is substantially equal to a voltage between both ends of a sensing resistor for detecting the driving current $I_{LED}$ of the current feedback unit 120. In one exemplary embodiment, for example, the DC voltage $V_{DC}$ may be greater than the driving voltage $V_{LEDOUT}$ by about 0.1 volt (V) to about 0.5 volt (V).

The current regulator 130 receives the driving current $I_{LED}$ from the current feedback unit 120 and outputs a plurality of string currents $I_{LED1}$ to $I_{LED4}$ for driving the at least one LED string 200, and maintains the string currents $I_{LED1}$ to $I_{LED4}$ based on compensation information of the driving current $I_{LED}$ (hereinafter referred to as "current compensation information"). In an exemplary embodiment, the current compensation information of the driving current $I_{LED}$ may be information based on a reference voltage $V_{REF}$. The reference voltage $V_{REF}$ is a voltage corresponding to luminance of light emitted from the at least one string 200.

The LED driving controller 140 detects the driving voltage $V_{LEDOUT}$ and the string voltages $V_{LED1}$ to $V_{LED4}$ to control the driving voltage $V_{LEDOUT}$, and senses the driving current $I_{LED}$ to compensate for the driving current $I_{LED}$. The LED driving controller 140 includes a voltage detector 142 and a current compensator 144.

The voltage detector 142 detects the driving voltage $V_{LEDOUT}$ from an input terminal of the current regulator 130 and the string voltages $V_{LED1}$ to $V_{LED4}$ from an input terminal of at least one LED string 200, and outputs the feedback voltage $V_{FB}$ corresponding to a relationship between the driving voltage $V_{LEDOUT}$ and the string voltages $V_{LED1}$ to $V_{LED4}$. In an exemplary embodiment, the feedback voltage $V_{FB}$ may be a voltage corresponding to a difference between the driving voltage $V_{LEDOUT}$ and the maximum value of the string voltages $V_{LED1}$ to $V_{LED4}$. In an alternative exemplary embodiment, the feedback voltage $V_{FB}$ may be a voltage corresponding to a difference between the driving voltage $V_{LEDOUT}$ and the minimum value of the string voltages $V_{LED1}$ to $V_{LED4}$.

The current compensator 144 senses the driving current $I_{LED}$ lowing in the current feedback unit 120, and outputs the current compensation information for compensating for the driving current $I_{LED}$ based on the sensed driving current $I_{LED}$ and the for the driving current $I_{LED}$ with the reference voltage $V_{REF}$. In an exemplary embodiment, the current compensation information may be an analog current or a digital control signal.

Hereinafter, as illustrated in FIG. 1, the current feedback unit 120, current regulator 130 and current compensator 144 are collectively referred to as a current source control unit 101. The current source control unit 101 senses the driving current $I_{LED}$, and controls/regulates/varies the string currents $I_{LED1}$ to $I_{LED4}$ flowing in the at least one LED string 200, based on the sensed driving current $I_{LED}$ and the reference voltage $V_{REF}$. The current source control unit 101 allows a constant current to flow in the at least one LED string 200.

In an exemplary embodiment, the current source control unit 101 compensates for a string current when light is emitted from at least one LED string 200.

The at least one LED string 200 includes a plurality of serially-connected LEDs. In an exemplary embodiment, an anode of the at least one LED string 200 may be connected to the current regulator 130, and a cathode of the at least one LED string 200 may be chassis-grounded. In one exemplary embodiment, for example, a first LED string 220 of the at least one LED string 200 has an anode that receives a first string voltage $V_{LED1}$ and first string current $I_{LED1}$ from the current regulator 130, and a chassis-grounded cathode.

In one exemplary embodiment, as illustrated in FIG. 1, the at least one LED string 200 may include four LED strings, but the invention is not limited thereto. The backlight unit 10 may include at least one LED string, e.g., more than four LED strings or less than four LED strings.

A conventional backlight unit controls a constant current at a cathode of an LED string. A method of controlling a constant current at a cathode of an LED string has been described in U.S. Patent Application Publication No. 2011/012521, which is filed by Samsung Electronics Co., Ltd and herein incorporated by reference.

In an exemplary embodiment, the backlight unit 10 controls a current at the anode of the at least one LED string 200, and chassis-grounds the cathode of the at least one LED string 200. In such an embodiment, even when any one of the LED strings 200 is shorted, the backlight unit 10 enables the control of a constant current for the LED string 200. In such an embodiment, the backlight unit 10 effectively prevents heat generation or ignition even when an LED string is shorted.

Exemplary embodiments of the invention that implement the current source control unit 101 of FIG. 1 as an analog circuit will now be described with reference to FIGS. 2 to 4. Hereinafter, for convenience of description, it is assumed that the at least one string 200 includes only one LED string, e.g., first LED string 220.

Figure 2:
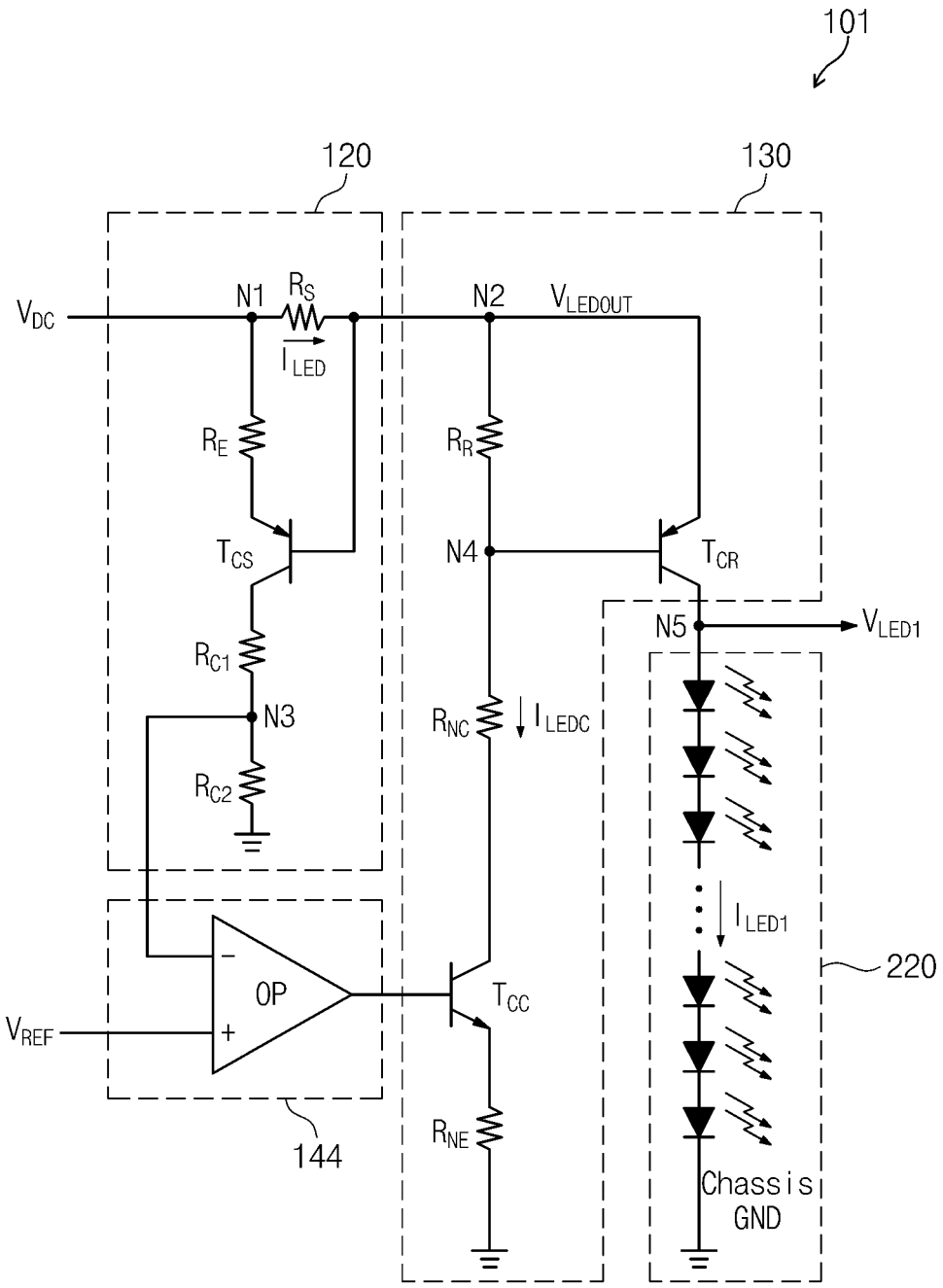
FIG. 2 is a block diagram illustrating an exemplary embodiment of a current source control unit according to the invention.

FIG. 2 is a block diagram illustrating an exemplary embodiment of a current source control unit 101 according to the invention. Referring to FIG. 2, the current source control unit 101 includes a current feedback unit 120, a current regulator 130 and a current compensator 144.

The current feedback unit 120 includes a sensing resistor $R_S$ connected between first and second nodes N1 and N2, an emitter resistor $R_E$ connected to the first node N1, a first collector resistor $R_{C1}$ connected to the third node N3, a second collector resistor $R_{C2}$ connected between the third node N3 and a ground terminal, and a current sensing transistor $T_{CS}$. In an exemplary embodiment, the current sensing transistor $T_{CS}$ has an emitter connected the emitter resistor $R_E$, a collector connected to the first collector resistor $R_{C1}$, and a base connected to the second node N2. The emitter resistor $R_E$ may have a low resistance value from about 0 ohm (Ω) to about 100 ohms (Ω). The emitter resistor $R_E$ functions to render current tuning be less sensitive.

In one exemplary embodiment, for example, the current sensing transistor $T_{CS}$ may be a P-channel (i.e., a P-N-P type) bipolar transistor.

The current feedback unit 120 senses a current in the sensing resistor $R_S$, and outputs a pertinent sensing voltage to the third node N3.

The current regulator 130 includes a voltage regulation resistor $R_R$ connected between the second node N2 and a fourth node N4, a compensation current collector resistor $R_{NC}$ connected to the fourth node N4, a compensation current emitter resistor $R_{NE}$ connected to the ground terminal, a current regulation transistor $T_{CR}$ and a current compensation transistor $T_{CC}$.

The current regulation transistor $T_{CR}$ outputs a string current $I_{LED1}$ corresponding to a voltage difference between the fourth node N4 and a fifth node N5. In such an embodiment, a voltage of the fourth node N4 varies based on a compensation current $I_{LEDC}$. Therefore, the current regulation transistor $T_{CR}$ may output the string current $I_{LED1}$ corresponding to the compensation current $I_{LEDC}$.

The current regulation transistor $T_{CR}$ has an emitter connected to the second node N2, a collector connected to the fifth node N5, and a base connected to the fourth node N4. In such an embodiment, the fifth node N5 corresponds to the anode of the LED string 200, and the string voltage $V_{LED1}$ is output through the fifth node N5. In one exemplary embodiment, for example, the current regulation transistor $T_{CR}$ may a P-channel bipolar transistor.

The current compensation transistor $T_{CC}$ outputs the compensation current $I_{LEDC}$ based on the current compensation information.

The current compensation transistor $T_{CC}$ has a collector connected to the compensation current collector resistor $R_{NC}$, an emitter connected to the compensation current emitter resistor $R_{NE}$, and a base that receives the current compensation information.

The current compensator 144 compares the reference voltage $V_{REF}$ and the sensing voltage from the current feedback unit 120 (i.e., the voltage of the third node N3) to output the current compensation information. The current compensator 144 includes an operational amplifier OP. The operational amplifier OP includes a positive input terminal (+) that receives the reference voltage $V_{REF}$, a negative input terminal (−) that receives the voltage of the third node N3, and an output terminal connected to the base of the current compensation transistor $T_{CC}$. The operational amplifier OP may output a voltage corresponding to a difference between the reference voltage $V_{REF}$ and the sensing voltage.

Controlling of the string current $I_{LED1}$ based on the reference voltage $V_{REF}$ in the current source control unit 101 will now be described in greater detail. Hereinafter, for convenience of description, it is assumed that a resistance value of the emitter resistor $R_E$ is 0 and a resistance value of the voltage regulation resistor $R_R$ is infinite. Therefore, a current LED flowing in the sensing resistor $R_S$ is the same as the string current $I_{LED1}$. The string current $I_{LED1}$ satisfies Equation I below.

$$I_{LED1} = \frac{V_{BE}}{R_S} = \frac{1}{R_S} \times V_T \cdot \log\frac{I_C}{I_S} = \frac{1}{R_S} \times V_T \cdot \log\frac{V_{REF}}{I_S \cdot R_S} \quad \text{(I)}$$

In Equation I, $V_{BE}$ is a voltage between the base and emitter of the current sensing transistor $T_{CS}$, $I_C$ is a current flowing in the collector of the current sensing transistor $T_{CS}$, $I_S$ is a reverse saturation current of the current sensing transistor $T_{CS}$, and $V_T$ is a thermal voltage that has a constant voltage at a room temperature (for example, about 300 kelvin [K]) of the current sensing transistor $T_{CS}$, and $R_C$ is the sum of $R_{C1}$ and $R_{C2}$.

As seen in Equation (1), the string current $I_{LED1}$ is proportional to the reference voltage $V_{REF}$.

Accordingly, the current source control unit 101 may regulate/control/vary the string current $I_{LED1}$ with the reference voltage $V_{REF}$.

In FIG. 2, the current feedback unit 120 of the current source control unit 101 senses a driving current $I_{LED}$ flowing in the sensing resistor $R_S$ to compensate for the string current $I_{LED1}$. In an exemplary embodiment, the current feedback unit 120 may sense the driving current $I_{LED}$ with a photocoupler.

Figure 3:
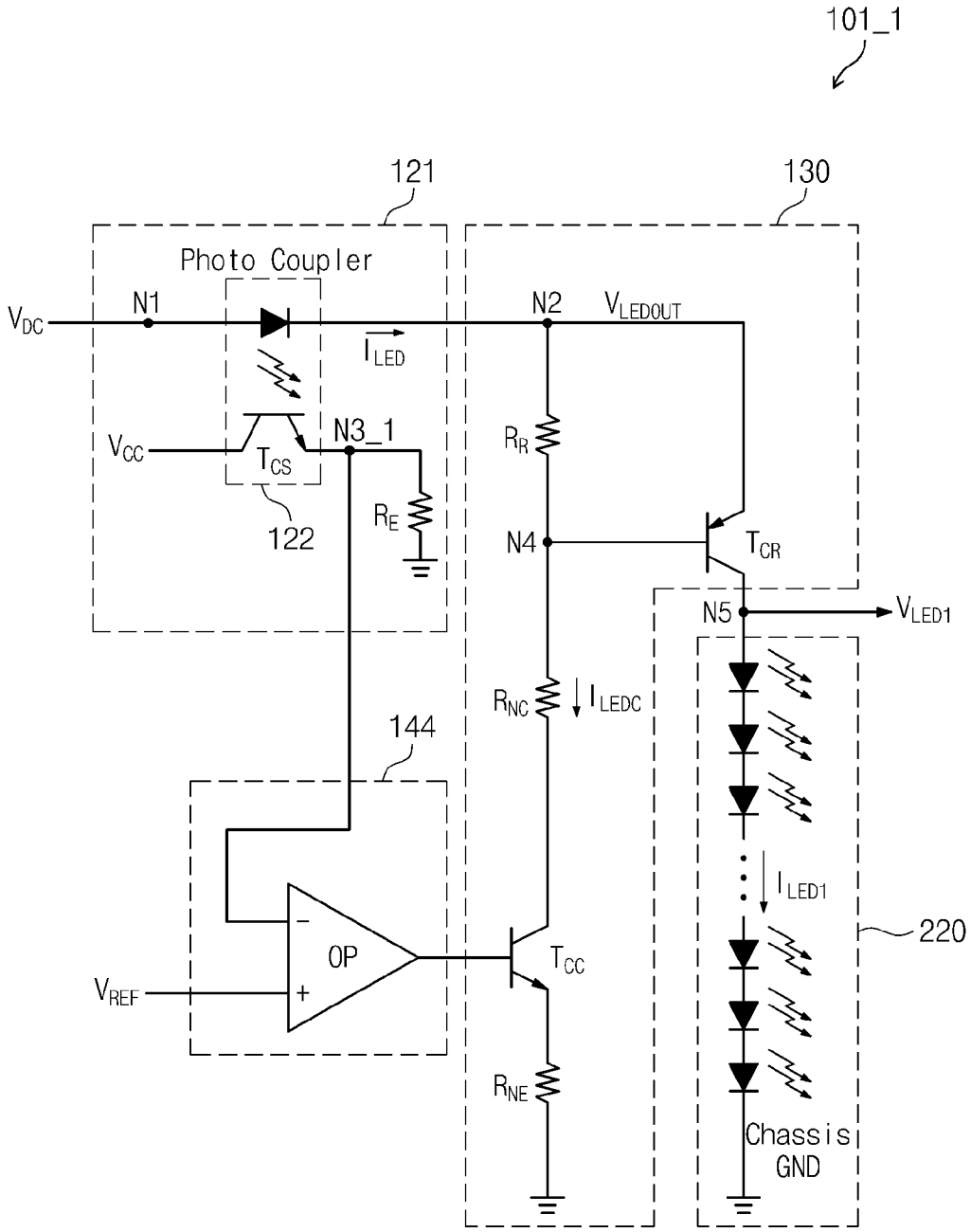
FIG. 3 is a block diagram illustrating an alternative exemplary embodiment of a current source control unit according to the invention.

FIG. 3 is a block diagram illustrating an alternative exemplary embodiment of a current source control unit according to the invention. Referring to FIG. 3, a current source control unit 101_1 includes a current feedback unit 121, a current regulator 130 and a current compensator 144. The current source control unit 101_1 shown in FIG. 3 includes a current feedback unit 121 having a configuration different from the configuration of the current source control unit 100 shown in FIG. 2.

The current feedback unit 121 includes a photocoupler 122, and an emitter resistor $R_E$ having one end connected to a ground terminal The photocoupler 122 emits light corresponding to a driving current $I_{LED}$, and outputs a sensing voltage of a third node N3_1 by allowing a current corresponding to the emitted light to flow. The photocoupler 122 includes a diode that receives a driving voltage $V_{AC}$ from a first node N1, outputs the driving current $I_{LED}$ to a second node N2, and emits the light corresponding to the driving current emitted from the diode. In an exemplary embodiment, the current sensing transistor $T_{CS}$ has a collector connected to a current compensation voltage $V_{CC}$, an emitter connected to the other end of an emitter resistor $R_E$, and a base that receives the light emitted from the diode. The current flowing in the current sensing transistor $T_{CS}$ is substantially proportional to the quantity of internal light emitted from the diode. The quantity of the internal light emitted from the diode is substantially proportional to the driving current $L_{ED}$.

In such an embodiment, the current source control unit 101_1 may regulate/control/vary the string current $I_{LED1}$ with the reference voltage $V_{REF}$.

In an exemplary embodiment, the current source control unit 101_1 may be realized in a current mirror structure.

Figure 4:
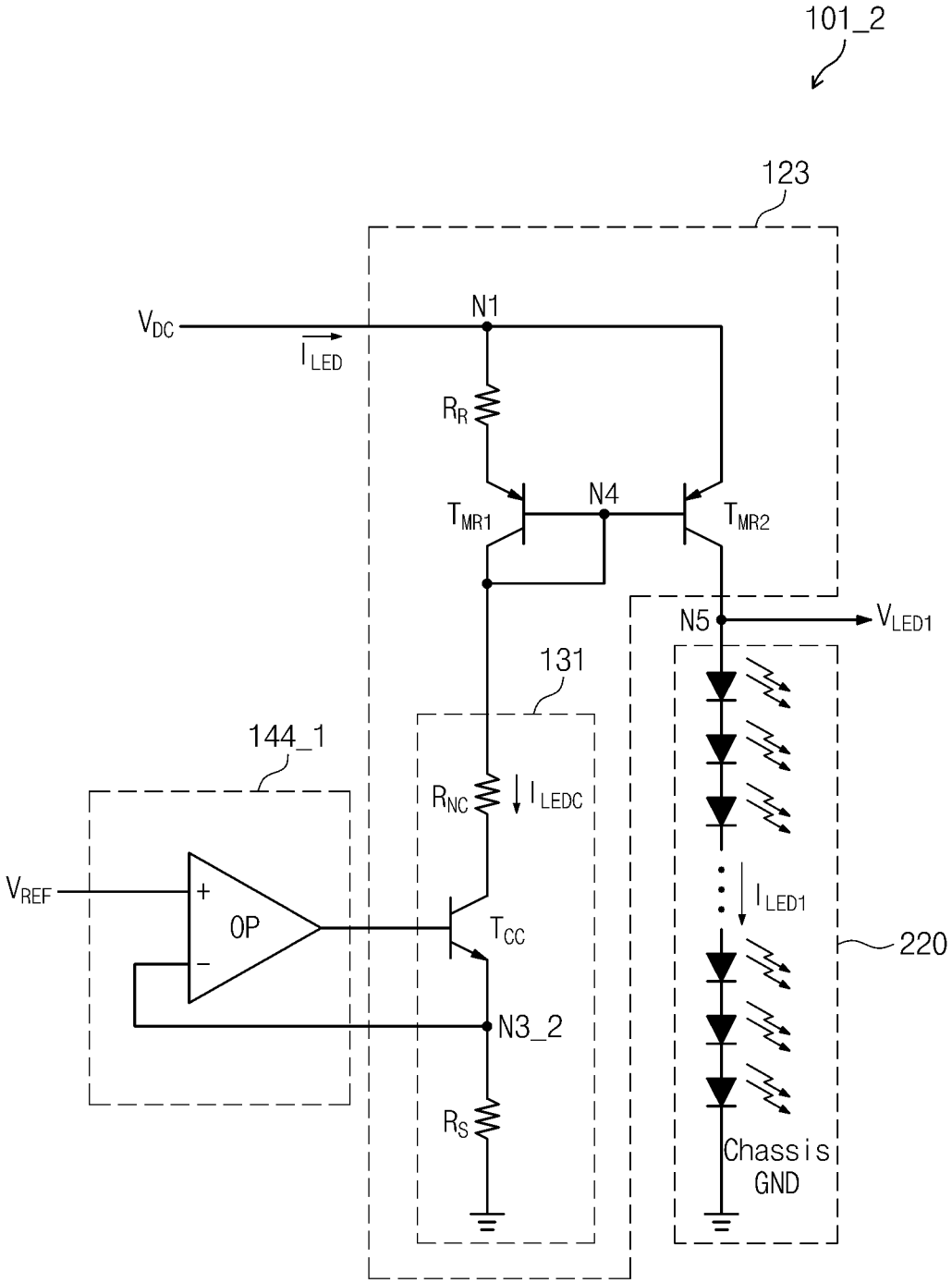
FIG. 4 is a block diagram illustrating another alternative exemplary embodiment of a current source control unit according to the invention.

FIG. 4 is a block diagram illustrating another alternative exemplary embodiment of a current source control unit according to the invention. Referring to FIG. 4, a current source control unit 1012 includes a current feedback unit 123 having a current mirror structure, a current regulator 131 and a current compensator 144_1.

The current feedback unit 123 includes a voltage regulation resistor $R_R$ having one end connected to a first node N1, a current compensation collector resistor $R_{NC}$ having one end connected to a fourth node N4, a sensing resistor $R_S$ connected between a third node N3_2 and a ground terminal, first and second current mirror transistors $T_{MR1}$ and $T_{MR2}$, and a current compensation transistor $T_{CC}$.

Herein, the first current mirror transistor $T_{MR1}$ has an emitter connected to the other end of the voltage regulation resistor $R_R$, and a collector and base commonly connected to the fourth node N4. The second current mirror transistor $T_{MR2}$ has an emitter connected to the first node N1, a collector connected to a fifth node N5 and a base connected to the fourth node N4. In the embodiment, each of the first and second current mirror transistors $T_{MR1}$ and $T_{MR2}$ may be a p-channel bipolar transistor.

Moreover, the current compensation transistor $T_{CC}$ includes a collector connected to the other end of the current compensation collector resistor $R_{NC}$, an emitter connected to the third node N3_2, and a base receiving the current compensation information.

The current regulator 131, as illustrated in FIG. 4, is provided in the current feedback unit 123 and outputs a compensation current $I_{LEDC}$ based on the current compensation information.

The current source control unit 101_2 of FIG. 4 may have a current mirror structure, and thus the compensation current $I_{LEDC}$ and the string current $I_{LED1}$ may have the same level. Therefore, the string current $I_{LED1}$ satisfies Equation II below.

$$I_{LED1} \cong \alpha \times I_{LEDC} = \frac{V_{REF}}{R_S} \quad \text{(II)}$$

In Equation II, a is a constant greater than 1 and predetermined based on the voltage regulation resistor $R_R$.

Accordingly, the current source control unit 1012 may regulate/control/vary the string current $I_{LED1}$ with the reference voltage $V_{REF}$.

In an exemplary embodiment, the at least one LED string 200 of FIG. 1 may have the shape of a bar.

Figure 5:
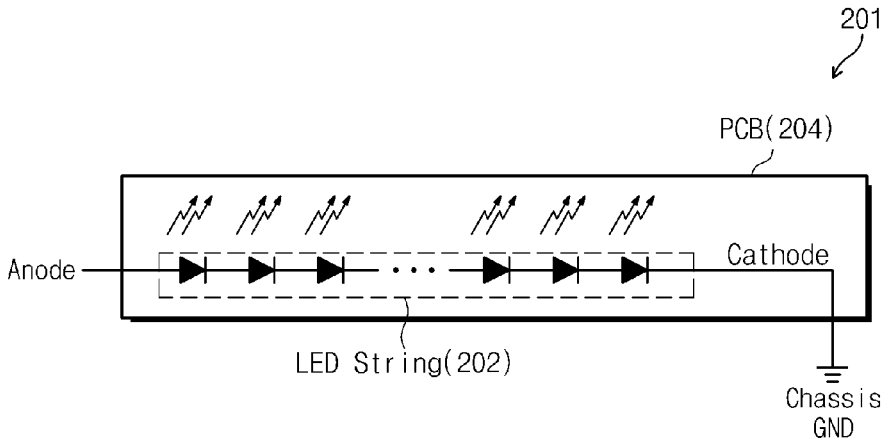
FIG. 5 is a block diagram illustrating an exemplary embodiment of an light emitting diode ("LED") bar according to the invention.

FIG. 5 is a block diagram illustrating an exemplary embodiment of an LED bar according to the invention. Referring to FIG. 5, an LED bar 201 includes an LED string 202 and a printed circuit board ("PCB") 204. A cathode of the LED string 202 is connected to the PCB 204, which is connected to a chassis. In an exemplary embodiment, the PCB 204 may be directly connected to the chassis. In an exemplary embodiment, the PCB 204 may be connected to the chassis with a screw.

Figure 6:
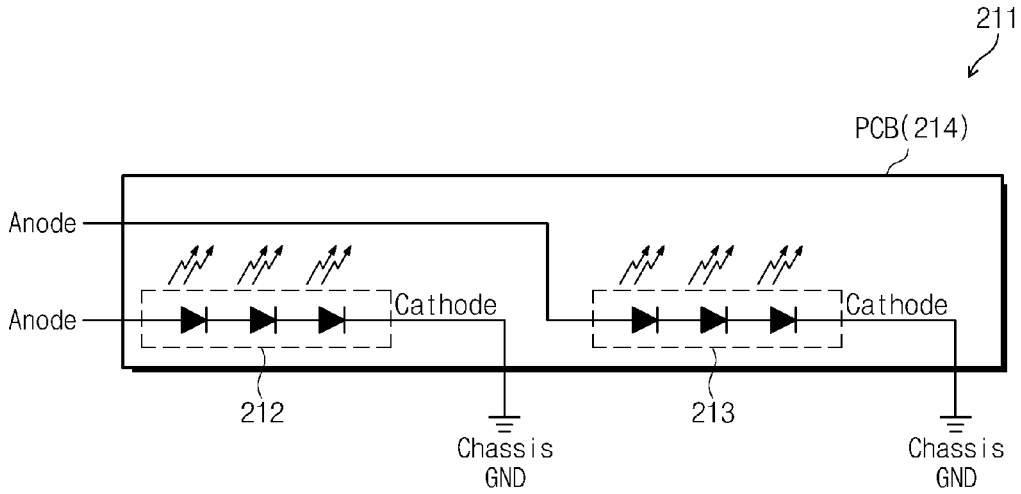
FIG. 6 is a block diagram illustrating an alternative exemplary embodiment of an LED bar according to the invention.

FIG. 6 is a block diagram illustrating an alternative exemplary embodiment of an LED bar according to the invention. Referring to FIG. 6, the LED bar 211 may include first and second LED strings 212 and 213, and a PCB 214. A cathode of each of the first and second LED strings 212 and 213 is connected to the PCB 214, which is connected to a chassis.

In an exemplary embodiment, as shown in FIG. 6, the LED bar 211 may include two LED strings, e.g., the first and second Led strings 211 and 213, but the invention is not limited thereto. In an alternative exemplary embodiment, the LED bar 211 may include three or more LED strings.

A conventional LED bar has a structure where both an anode and a cathode are connected to an LED driving circuit.

In an exemplary embodiment of an LED bar according to the invention, for example, in the LED bars 201 and 211 in FIGS. 5 and 6, a cathode of an LED string may be chassis-grounded, and thus, only an anode may be connected to an LED driving circuit (for example, the LED driving circuit 100 in FIG. 1). In an exemplary embodiment where the LED bar includes a plurality of LED strings, the number of connected pins in the LED bar is substantially reduced, and the LED bar is substantially efficiently connected with the LED driving circuit 100. In an exemplary embodiment, the number of connected pins may correspond to the number of anodes in the LED strings.

In an exemplary embodiment, the connection between the LED bar and the LED driving circuit 100 may be implemented in a socket type.

In an exemplary embodiment, an LED bar may be connected to the LED driving circuit 100 disposed, e.g., mounted, on a substrate of a source driver (not shown) via cable.

Figure 7:
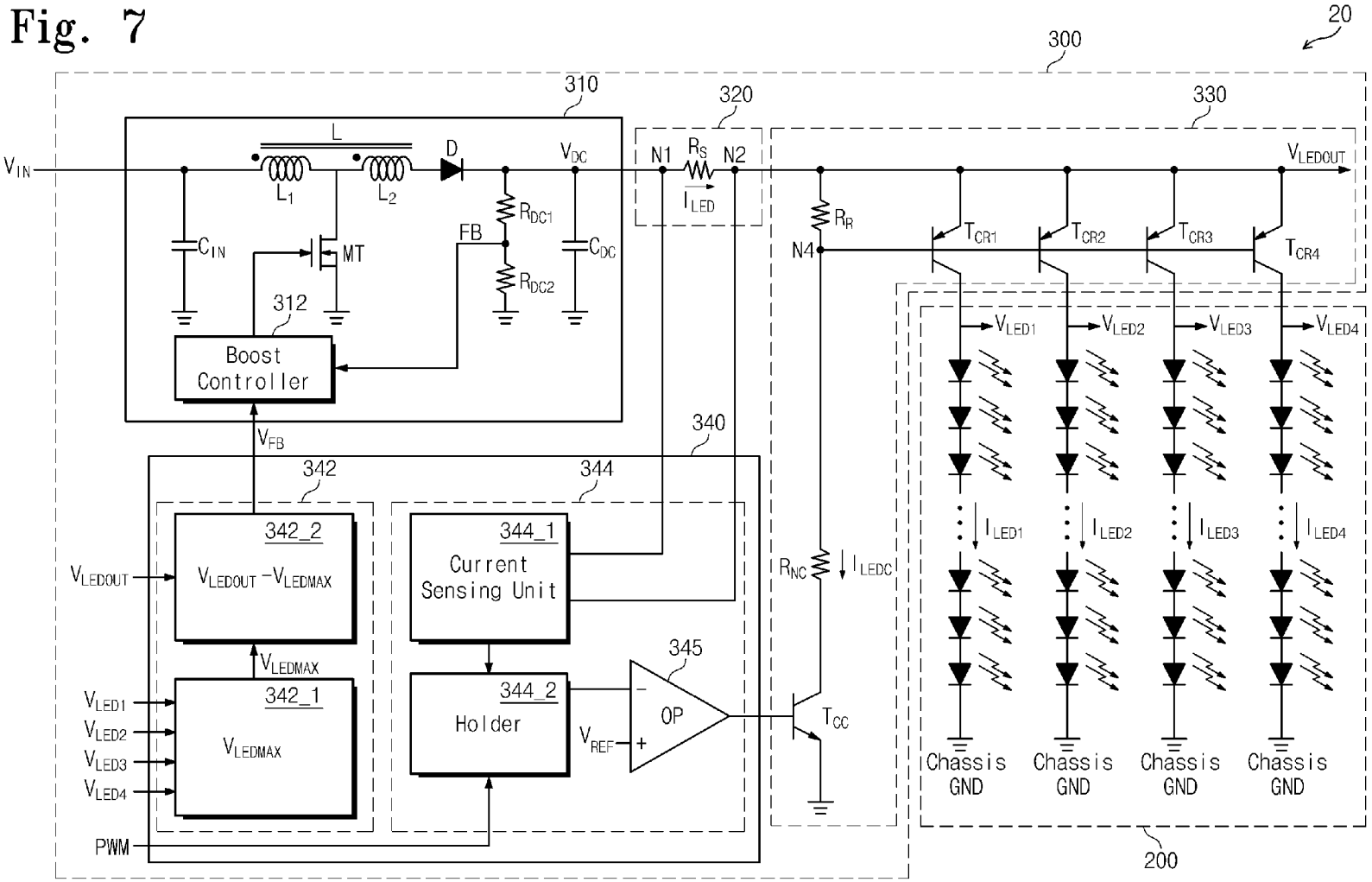
FIG. 7 is a block diagram illustrating an exemplary embodiment of the backlight unit.

FIG. 7 is a block diagram illustrating an exemplary embodiment of a backlight unit. Referring to FIG. 7, the backlight unit 20 includes a plurality of LED strings 200, e.g., four LED strings, and an LED driving circuit 300 that controls the LED strings 200.

The LED driving circuit 300 includes a DC-to-DC converter 310, a current feedback unit 320, a current regulator 330 and an LED driving controller 340.

The DC-to-DC converter 310 boosts the input source voltage $V_{IN}$ with an inductor L. In an exemplary embodiment, the source voltage $V_{IN}$ may be in a range from about 22 V to about 26 V. In an exemplary embodiment, the DC-to-DC converter 310 may be implemented as a coupled inductor boost converter.

The DC-to-DC converter 310 includes an input capacitor $C_{IN}$, an output capacitor $C_{DC}$, an inductor L, a boosting control transistor MT, a diode D, a plurality of dividing resistors $R_{DC1}$ and $R_{DC2}$, and a boost controller 312.

When the boosting control transistor MT is turned off, a voltage is stored in a first inductor L1 with the input voltage $V_{IN}$. When the boosting control transistor MT is turned on, a reverse bias is applied to the diode D, and thus, the voltage stored in the first inductor L1 is applied to a second inductor L2.

The boost controller 312 outputs a boosting control signal to a gate of the boosting control transistor MT, and controls a duty cycle of the boosting control signal based on first and second feedback voltages FB and $V_{FB}$. In an exemplary embodiment, the first feedback voltage FB is a divided voltage corresponding to a DC voltage $V_{DC}$ of a first node N1 (for example, $V_{DC} \times R_{DC1}/(R_{DC1}+R_{DC2})$), and the second feedback voltage $V_{FB}$ is a voltage corresponding to a relationship between a driving voltage $V_{LEDOUT}$ and a plurality of string voltages LED1 to LED4 (for example, $V_{LEDOUT}-V_{LEDMAX}$).

In an exemplary embodiment, pulse width modulation ("PWM") or pulse frequency modulation ("PFM") may be used in controlling the duty cycle. Hereinafter, for convenience of description, it is assumed that PWM is used in controlling the duty cycle.

The current feedback unit 320 outputs a power corresponding to a DC voltage $V_{DC}$ output from the DC-to-DC converter 310 and the driving current $I_{FED}$. In such an embodiment, the output power may correspond to the driving voltage $V_{LEDOUT}$ and the driving current $I_{LED}$. The driving voltage $V_{LEDOUT}$ is a voltage obtained by subtracting a voltage between both ends of a sensing resistor $R_S$ from the DC voltage $V_{DC}$. The current feedback unit 320 includes the sensing resistor $R_S$ connected between first and second nodes N1 and N2. The driving current $I_{FED}$ flows in the sensing resistor $R_S$.

The current regulator 330 receives the driving voltage $V_{LEDOUT}$ and the driving current $I_{LED}$ to output the string voltages LED1 to LED4 to the LED strings 200, respectively, in a current mirror scheme, and compensates for the string voltages LED1 to LED4 based on the current compensation information. The current regulator 330 includes a voltage regulation resistor $R_R$, a current compensation collector resistor $R_{NC}$, a plurality of current regulating transistors $T_{CR1}$ to $I_{CR4}$, and a current compensation transistor $T_{CC}$. A string current supplying method or string current compensating method of the current regulator 330 is substantially similar to the methods described above with reference to FIGS. 2 to 4, and thus any repetitive detailed description thereof will hereinafter be omitted.

The LED driving controller 330 controls the driving voltage $V_{LEDOUT}$ and the driving current $I_{LED}$ by outputting a feedback voltage $V_{FB}$ corresponding to a relationship between the driving voltage $V_{LEDOUT}$ and the string voltages $V_{LED1}$ to $V_{LED4}$. The LED driving controller 330 senses the driving current $I_{LED}$ to output the current compensation information, thereby compensating for the string voltages $V_{LED1}$ to $V_{LED4}$.

The LED driving controller 340 includes a voltage detector 342 and a current compensator 344. The voltage detector 342 includes a maximum voltage detector 342_1 and a feedback voltage generator 342_2. The maximum voltage detector 342_1 outputs a string voltage, having the highest level among the string voltages $V_{LED1}$ to $V_{LED4}$, as a maximum string voltage $V_{LEDMAX}$.

In an exemplary embodiment, when a voltage deviation (a difference between a minimum string voltage and a maximum string voltage) of the voltage detector 342 is greater than a predetermined value (for example, when some LED strings are shorted), the LED driving controller 340 may be configured to protect the LED strings 200.

The feedback voltage generator 342_2 outputs the feedback voltage $V_{FB}$ corresponding to a difference between the driving voltage $V_{LEDOUT}$ and the maximum string voltage $V_{LEDMAX}$.

In an exemplary embodiment, the LED driving controller 340 may control the driving voltage $V_{LEDOUT}$ such that a voltage difference (a difference between the driving voltage $V_{LEDOUT}$ and the maximum string voltage $V_{LEDMAX}$) of the feedback voltage generator 342_2 maintains a predetermined value (for example, about 1 V).

In such an embodiment, when the voltage difference of the feedback voltage generator 342_2 is equal to or less than a predetermined value (for example, about 0.5 V) (for example, when some LED strings are shorted), the LED driving controller 340 may be configured to protect the LED strings 200.

The current compensator 344 includes a current sensing unit 344_1, a holder 344_2 and an operational amplifier 345.

The current sensing unit 344_1 senses a sensing current $I_{LED}$ by sensing voltages between both ends of the sensing resistor $R_S$.

The holder 344_2 maintains a voltage, corresponding to the driving current $I_{LED}$ sensed by the current sensing unit 344_1, based on a PWM signal PWM.

The operational amplifier 345 compares a voltage output from the holder 344_2 and the reference voltage $V_{REF}$ to output the current compensation information.

The backlight unit 20 senses the driving current $I_{LED}$ at a hot side (corresponding to an anode), and compensates for the string currents $I_{LED1}$ to $I_{LED4}$ based on the sensed driving current $I_{LED}$.

In FIGS. 1 to 8, each of the current feedback units 120 and 320 outputs one driving current $I_{LED}$ and one driving voltage $V_{LEDOUT}$. However, the invention is not limited thereto. In an alternative exemplary embodiment, the current feedback unit may output a plurality of driving currents and driving voltages respectively corresponding to a plurality of LED strings.

Figure 8:
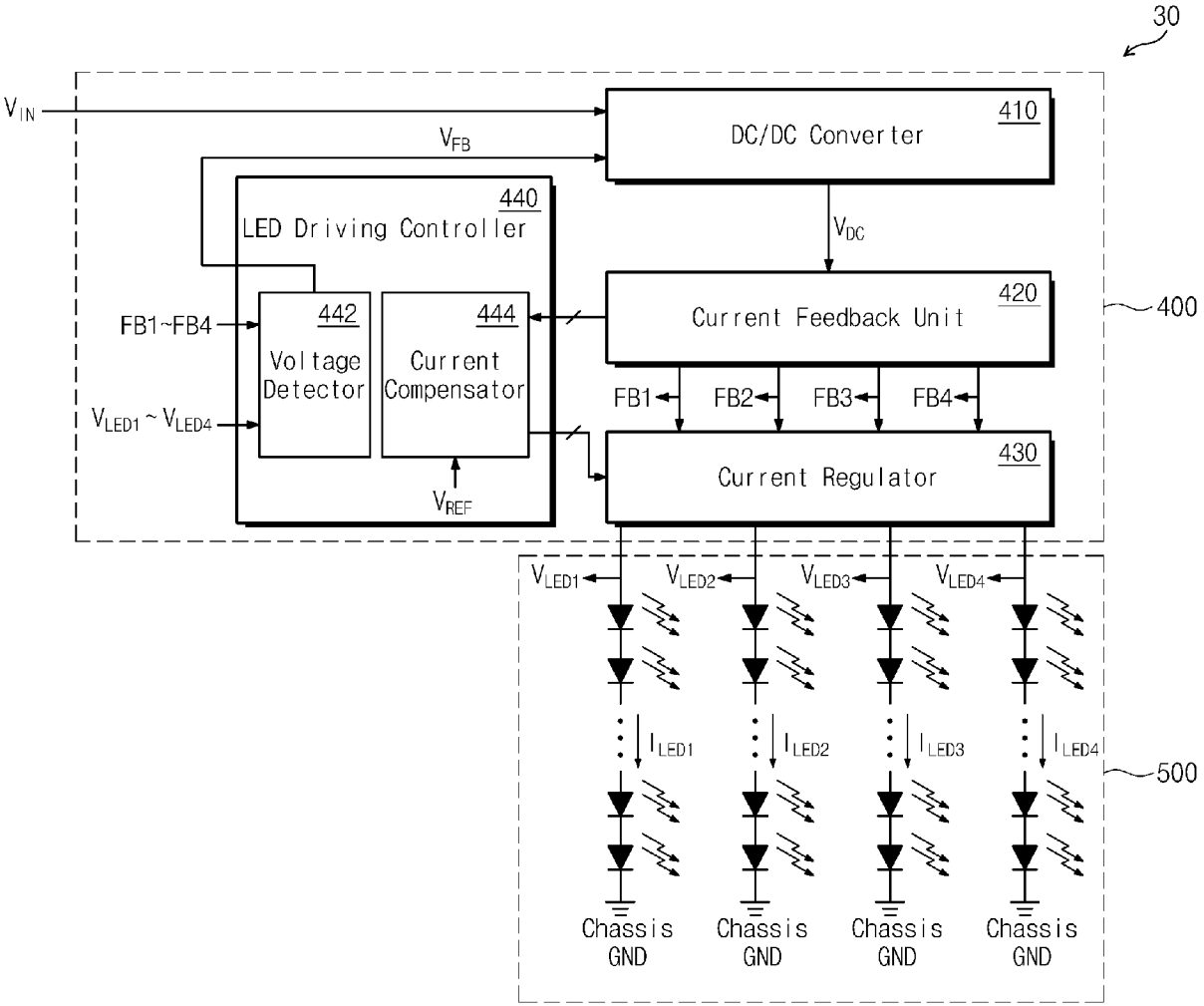
FIG. 8 is a block diagram illustrating an alternative exemplary embodiment of the backlight unit according to the invention.

FIG. 8 is a block diagram illustrating an alternative exemplary embodiment of a backlight unit according to the invention. Referring to FIG. 8, a backlight unit 30 includes an LED driving circuit 400 and a plurality of LED strings 500. The LED driving circuit 400 in FIG. 8 is substantially the same as the LED driving circuit 100 of FIG. 1 except that a current feedback unit 420 outputs a plurality of driving currents (not shown) and driving voltages (not shown) respectively corresponding to the LED strings 500.

A plurality of voltages FB1 to FB 4 in FIG. 8 are the driving voltages output from the current feedback unit 420, respectively. Also, a plurality of voltages $V_{LED1}$ to $V_{LED4}$ in FIG. 8 are voltages into which string voltages of respective anodes of the LED strings 500 are divided. Hereinafter, the voltages $V_{LED1}$ to $V_{LED4}$ are referred to as divided string voltages.

An LED driving controller 440 includes a voltage detector 442 and a current compensator 444. In an exemplary embodiment, the voltage detector 442 generates the feedback voltage $V_{FB}$ corresponding to a relationship between the driving voltages FB1 to FB4 and the divided string voltages $V_{LED1}$ to $V_{LED4}$. In an exemplary embodiment, the current compensator 444 senses the driving currents, which are respectively corresponding to the LED strings 500, and outputs the current compensator information based on the reference voltage $V_{REF}$.

The backlight unit 30 may individually control (for example, regulate or compensate for) the string currents $I_{LED1}$ to $I_{LED4}$ flowing in the LED strings 500, respectively.

In an exemplary embodiment, the LED driving circuit may be implemented as an integrated circuit ("IC").

Figure 9:
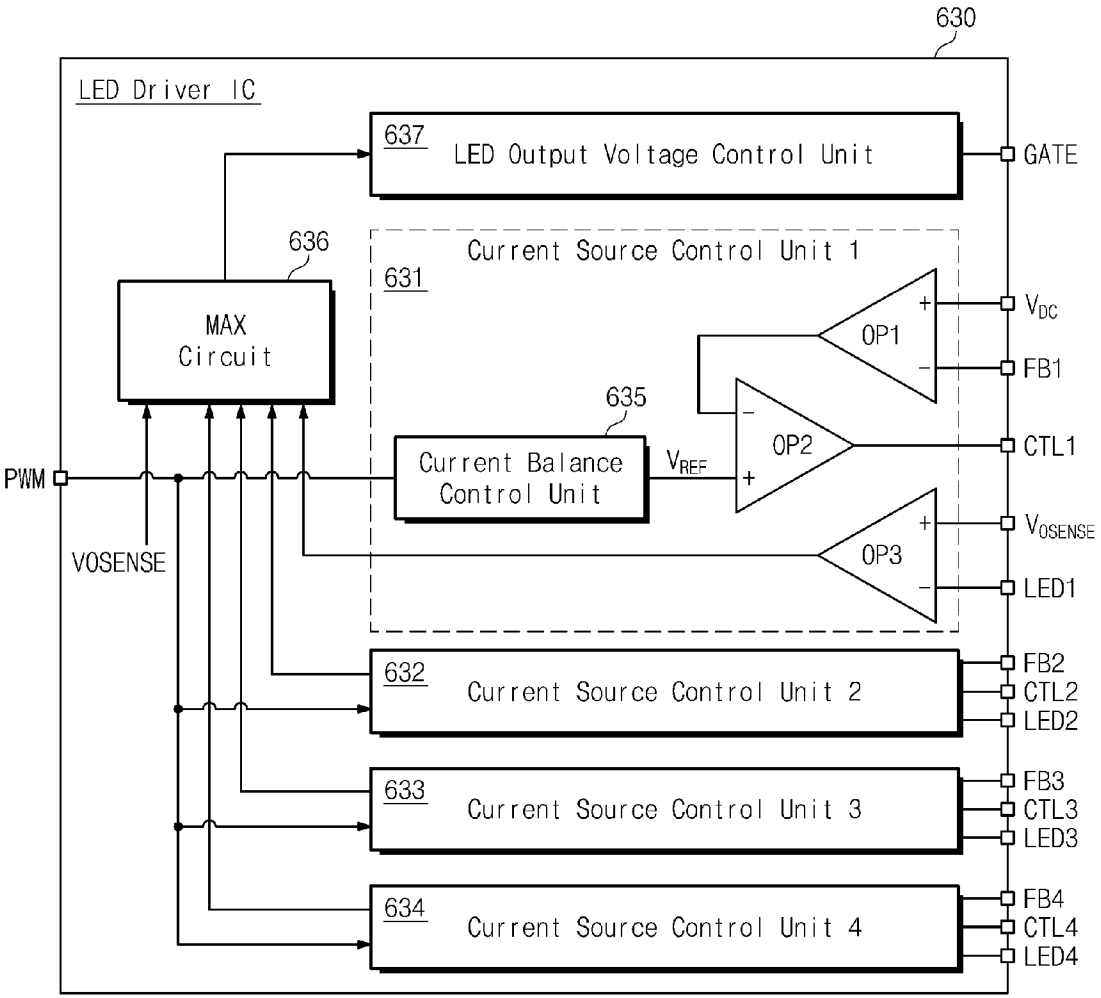
FIG. 9 is a block diagram illustrating an exemplary embodiment of an LED driving integrated circuit (IC) according to the invention.

FIG. 9 is a block diagram illustrating an exemplary embodiment of an LED driving IC 630 according to the invention. Hereinafter, for convenience of description, it is assumed that the LED driving IC 630 controls four LED strings. Referring to FIG. 9, the LED driving IC 630 includes first to fourth current source control units 631 to 634, a maximum value circuit 636 and an LED output voltage control unit 637.

The first to fourth current source control units 631 to 634 output current control signals CTL1 to CTL4 corresponding to current control information based on a reference voltage $V_{REF}$ and voltages (for example, voltage differences between a DC voltage $V_{DC}$ and driving voltages FB1 to FB4) corresponding to driving currents which pertain to a plurality of LED strings (not shown), respectively. In an exemplary embodiment, the first to fourth current source control units 631 to 634 output driving voltage control information (or a feedback voltage) based on corresponding voltages between the DC voltage $V_{DC}$ and string voltages, respectively (for example, voltage differences between a divided DC voltage $V_{OSENSE}$ and the divided string voltages LED1 to LED4).

Hereinafter, a configuration of a first current source control unit 631 will be described. The first current source control unit 631, as illustrated in FIG. 9, includes first to third operational amplifiers OP1 to OP3 and a current balance control unit 635.

The first operational amplifier OP1 outputs a voltage corresponding to a voltage difference between the DC voltage $V_{DC}$ and the first driving voltage FB1. The first operational amplifier OP1 includes a positive input terminal (+) that receives the DC voltage $V_{DC}$ and a negative input terminal (−) that receives the first driving voltage FB1.

The second operational amplifier OP2 outputs a voltage, corresponding to a difference between the reference voltage $V_{REF}$ and the output voltage of the first operational amplifier OP1, as the first current control signal CTL1. The second operational amplifier OP2 includes a positive input terminal (+) that receives the reference voltage $V_{REF}$ and a negative input terminal (−) that receives the output voltage of the first operational amplifier OP1.

The third operational amplifier OP3 outputs a voltage corresponding to a difference between the divided DC voltage $V_{OSENSE}$ and the first divided string voltage LED1. The divided DC voltage $V_{OSENSE}$ is a voltage into which the DC voltage $V_{DC}$ is divided at a predetermined ratio. The third operational amplifier OP3 includes a positive input terminal (+) that receives the divided DC voltage $V_{OSENSE}$ and a negative input terminal (−) that receives the first divided string voltage LED1.

The current balance control unit 635 generates the reference voltage $V_{REF}$ in response to the PWM signal. In an exemplary embodiment, the reference voltage $V_{REF}$ is a voltage corresponding to luminance of each of the LED strings.

The second to fourth current source control units 632 to 634 may have structures substantially identical to the structure of the first current source control unit 631.

The maximum value circuit (MAX circuit) 636 generates a voltage corresponding to the divided DC voltage $V_{OSENSE}$ and the highest voltage among the output voltages of the first to fourth current source control units 631 to 634.

The LED output control unit 637 outputs the driving voltage control information for maintaining the output voltage of the maximum value circuit 636 as a predetermined value. In an exemplary embodiment, the LED output control unit 637 may output the driving voltage control information such that a voltage difference between the driving voltage and the maximum string voltage is maintained as a voltage in range from about 0.3 V to about 1.5 V.

Figure 10:
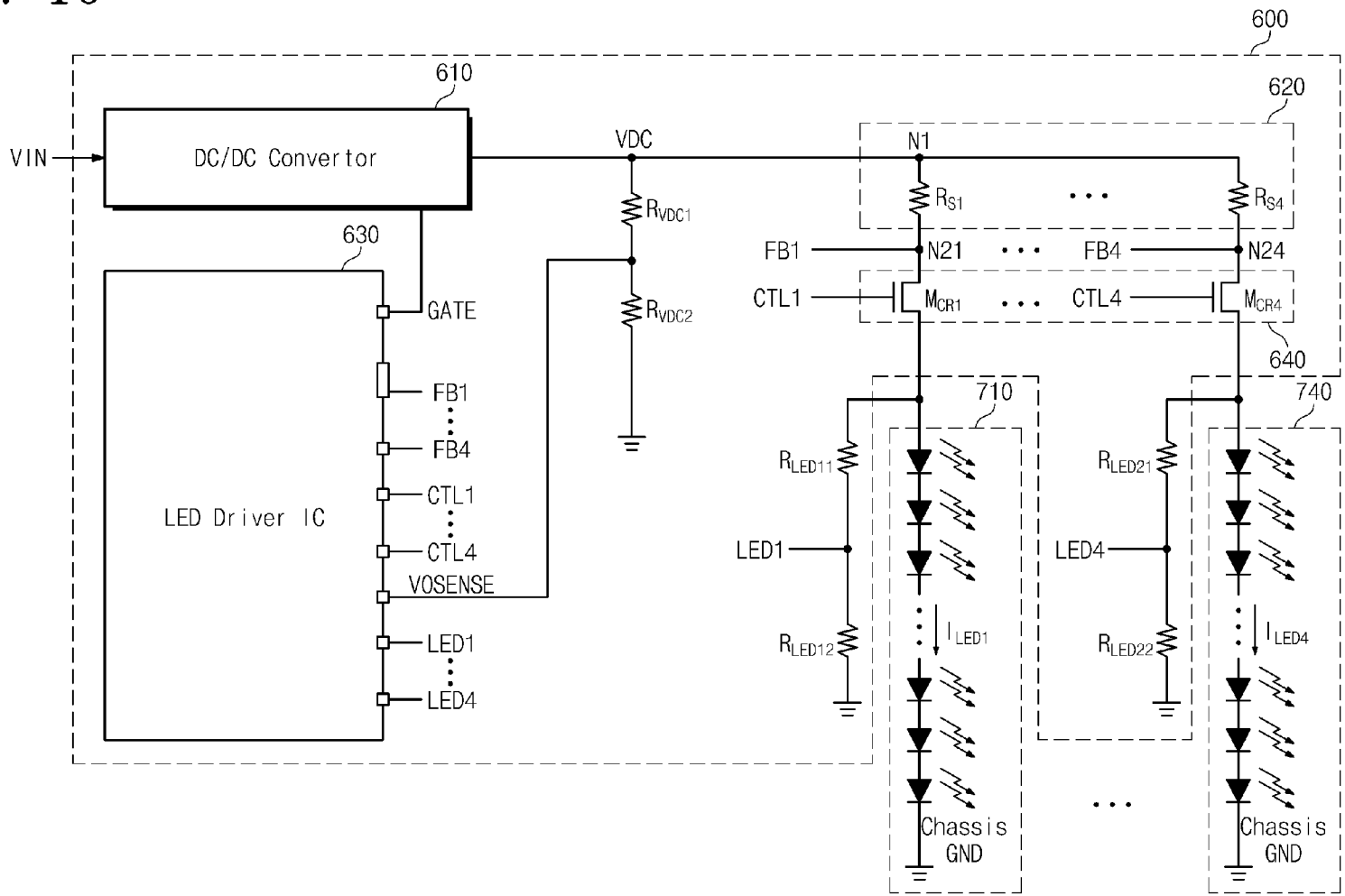
FIG. 10 is a block diagram illustrating an exemplary embodiment of an LED driving circuit using the LED driving IC of FIG. 9.

FIG. 10 is a block diagram illustrating an exemplary embodiment of an LED driving circuit 600 using the LED driving IC 630 of FIG. 9. Referring to FIG. 10, the LED driving circuit 600 includes a DC-to-DC converter 610, a current feedback unit 620, a current regulator 640, an LED driving IC 630, and a plurality of resistors $R_{VDC1}$, $R_{VDC2}$, $R_{LED11}$ to $R_{LED41}$, and $R_{LED12}$ to $R_{LED42}$.

The DC-to-DC converter 610 boosts an input source voltage $V_{IN}$ to output a DC voltage $V_{DC}$ and a driving current, and controls the DC voltage $V_{DC}$ based on driving voltage control information. The driving voltage control information is inputted through a gate pin GATE of the LED driving IC 630.

The current feedback unit 620 includes a plurality of sensing resistors $R_{S1}$ to $R_{s4}$ that sense driving currents corresponding to string currents $I_{LED1}$ to $I_{LED4}$ flowing in the LED strings 710 to 740, respectively. To sense the driving currents, nodes N21 to N24 connected to respective ends of the sensing resistors $R_{S1}$ to $R_{S4}$ are connected to pins that receives driving voltages FB1 to FB4 of the LED driving IC 630, respectively, and a voltage $V_{OSENSE}$, into which the DC voltage $V_{DC}$ is resistor-divided, is connected to a pin receiving the divided DC voltage $V_{OSENSE}$ of the LED driving IC 630. The divided DC voltage $V_{OSENSE}$ is generated by dividing the DC voltage $V_{DC}$ by a predetermined value (which is $R_{VDC1}/(R_{VDC1}+R_{VDC2})$).

The current regulator 640 includes a plurality of metal-oxide-semiconductor ("MOS") transistors $M_{CR1}$ to $M_{CR4}$ that output the string currents $I_{LED1}$ to $I_{LED4}$ to the LED strings 710 to 740 in response to a plurality of current control signals CTL1 to CTL4, respectively. In an exemplary embodiment, gates of the MOS transistors $M_{CR1}$ to $M_{CR4}$ are connected to pins for outputting the current control signals CTL1 to CTL4 of the LED driving IC 630, respectively.

Voltages LED1 to LED4, into which the string voltages of the LED strings 710 to 740 are respectively divided, are connected to pins that receive the divided string voltages LED1 to LED4 of the LED driving IC 630, respectively.

In an exemplary embodiment, the LED driving circuit 600 may be configured as a digital circuit, and may digitally sense and compensate for the driving currents flowing in the LED strings, respectively, at respective hot sides.

Figure 11:
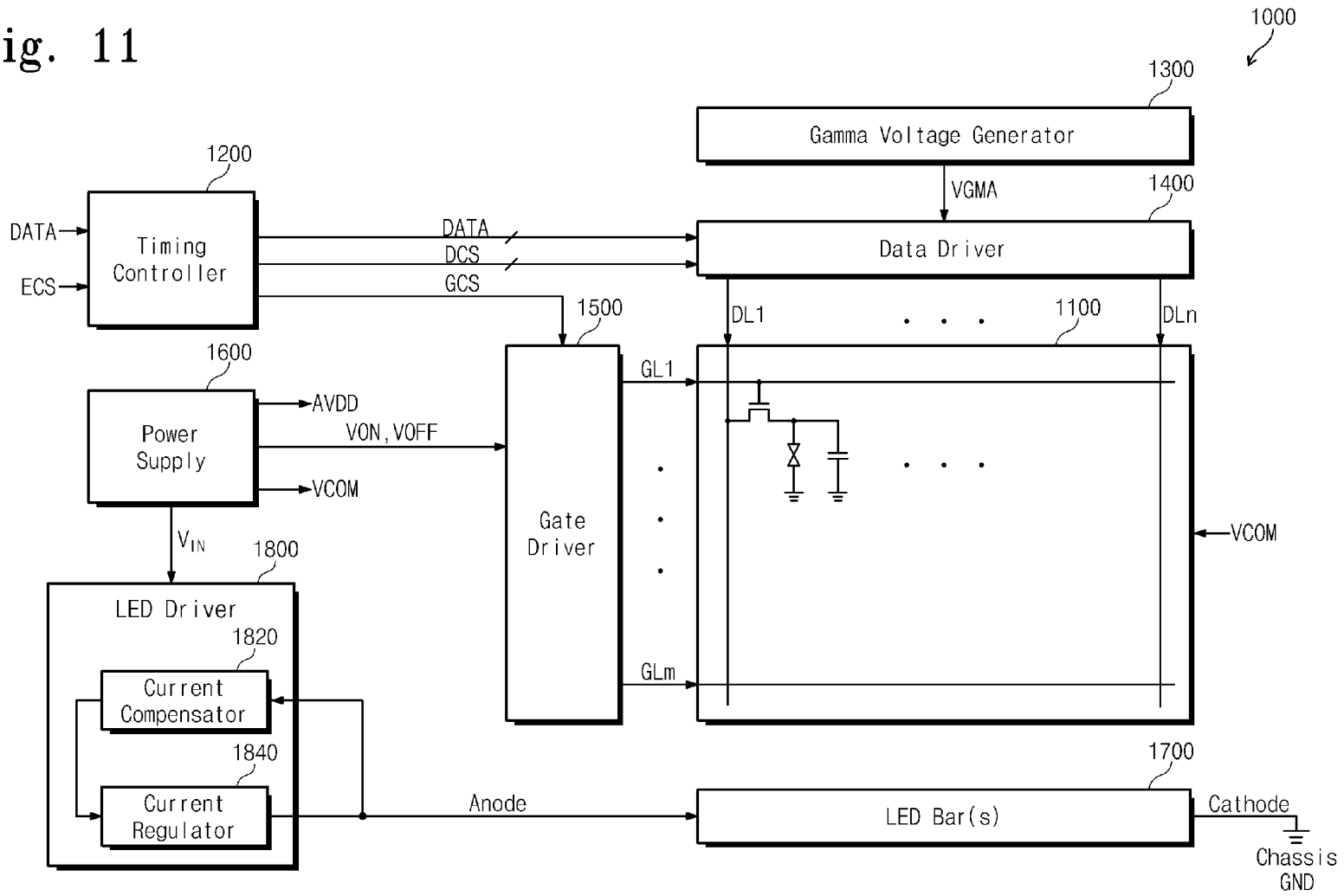
FIG. 11 is a block diagram illustrating an exemplary embodiment of an LCD device according to the invention.

FIG. 11 is a block diagram illustrating an exemplary embodiment of an LCD device 1000 according to the invention. Referring to FIG. 11, the LCD device 1000 includes a pixel array 1100, a timing controller 1200, a gamma voltage generator 1300, a data driver 1400, a gate driver 1500, a power supply 1600, at least one LED bar 1700 and an LED driver 1800.

The pixel array 1100, timing controller 1200, gamma voltage generator 1300, data driver 1400, gate driver 1500 and power supply 1600 have been specifically described in U.S. Patent Application Publication No. 2010/0315325, filed by Samsung Electronics Co., Ltd. and herein incorporated by reference, and thus, the detailed description thereof will hereinafter be omitted.

The at least one LED bar 1700 in FIG. 11 is substantially the same as the at least one LED bar 200 of FIG. 1.

In an exemplary embodiment, the LED driver 1800 outputs a driving current to an anode of the at least one LED bar 1700, and senses and compensates for the driving current flowing in the anode. The LED driver 1800 includes a current compensator 1820 and a current regulator 1840. In such an embodiment, the current compensator 1820 senses the driving current output to the anode of the at least one LED bar 1700 and outputs current compensation information. The current regulator 1840 outputs the driving current to the anode based on the current compensation information. The LED driving circuit 1800 in FIG. 11 may be substantially the same as the LED driving circuit 100 of FIG. 1.

Figure 12:
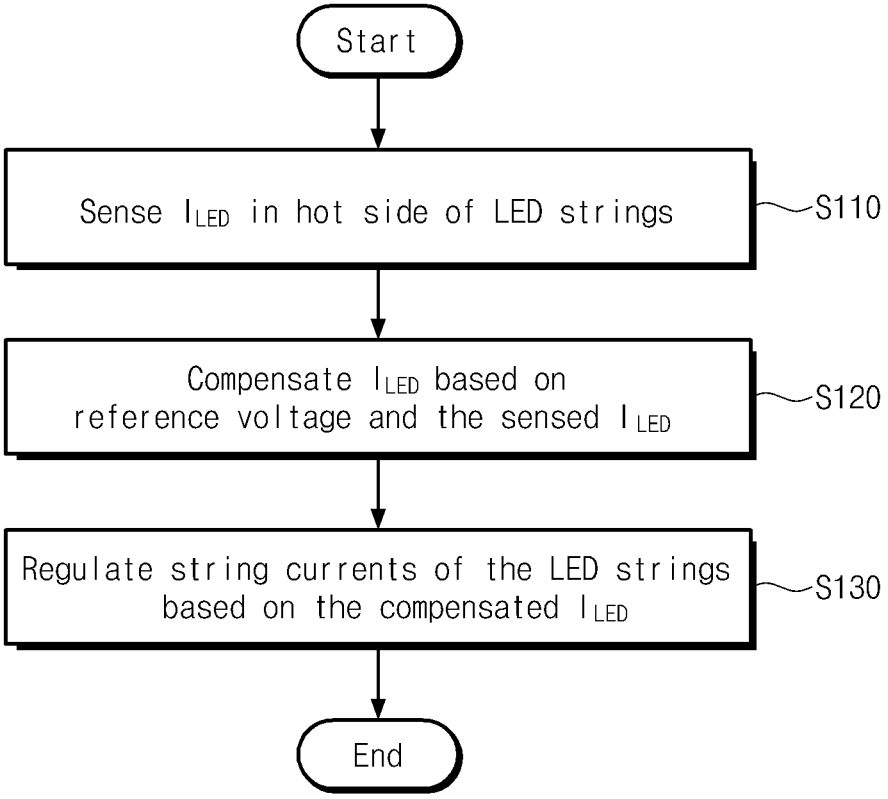
FIG. 12 is a flowchart illustrating an exemplary embodiment of a current control method of an LED driving circuit according to the invention.

FIG. 12 is a flowchart illustrating an exemplary embodiment of a current control method of an LED driving circuit according to the invention. Hereinafter, the current control method of the LED driving circuit will be described referring to FIGS. 1 and 12.

In an exemplary embodiment, the current compensator 144 senses a driving current $I_{LED}$ at a hot side (or an anode) of each of the LED strings 200 (S110). The current compensator 144 senses the driving current $I_{LED}$ by sensing a voltage difference of a sensing resistor $R_S$. In such an embodiment, a cold side (or a cathode) of each of the LED strings 200 is chassis-grounded.

In such an embodiment, the current compensator 144 outputs the current compensation information for compensating for the driving current $I_{LED}$, based on a voltage corresponding to the sensed driving current $I_{LED}$ and the reference voltage $V_{REF}$, and the current regulator 130 compensates for the driving current $I_{LED}$ based on the current compensation information (S120).

In such an embodiment, the current regulator 130 regulates string currents respectively flowing in the LED strings 200 according to the compensated driving current $I_{LED}$ (S130). A cold side (or a cathode) of each LED string 200 is chassis-grounded.

In an exemplary embodiment of the current control method of the LED driving circuit, a driving current at a hot side is sensed and compensated such that a constant current are effectively controlled even when at least one of the LED strings is shorted.

In an exemplary embodiment of the backlight unit and current control method thereof, a cathode is chassis-grounded and a driving current flowing in an anode is sensed to compensate for the driving current such that a constant current is supplied even when an LED string is shorted. Accordingly, heat generation or ignition is effectively prevented even when an LED string is shorted.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A backlight unit comprising:

at least one light emitting diode (LED) string having an anode, which receives a string current, and a chassis-grounded cathode; and a current source control unit which receives a driving current and outputs the string current to the at least one LED string, wherein the current source control unit senses the driving current and compensates for the string current based on the sensed driving current and a reference voltage, and wherein the reference voltage correspond to luminance of light emitted from the at least one LED string.

2. The backlight unit of claim 1, wherein the current source control unit comprises:

a current feedback unit connected between a first node and a second node, and which receives a direct current (DC) voltage from the first node to output a driving voltage to the second node and outputs the driving current to the second node;

a current compensator which senses the driving current flowing in the current feedback unit and compares the sensed driving current and the reference voltage to output current compensation information; and a current regulator connected between the second node and the anode, and which receives the driving voltage and the driving current to output the string current and compensates for the string current based on the current compensation information.

3. The backlight unit of claim 2, wherein the current feedback unit comprises a sensing resistor between the first node and the second node, and the current compensator senses a voltage difference between a voltage of the first node and a voltage of the second node to sense the driving current flowing in the sensing resistor.

4. The backlight unit of claim 2, wherein the current feedback unit comprises:

a photodiode between the first node and the second node and which emits light; and a photocoupler comprising a transistor which is turned on based on the light emitted from the photodiode, wherein the light emitted from the photodiode corresponds to the driving current.

5. The backlight unit of claim 1, wherein the current source control unit comprises:

an operational amplifier which receives the reference voltage and a voltage corresponding to the driving current to output a voltage corresponding to the current compensation information;

a current compensation transistor which is turned on based on the voltage corresponding to the current compensation information; and a current regulator having a current mirror structure, wherein the current regulator outputs the string current in response to a current flowing in the current compensation transistor.

6. The backlight unit of claim 1, wherein when light is emitted from the at least one LED string, the current source control unit compensates for the string current.

7. A backlight unit comprising:

at least one light emitting diode (LED) string having an anode, which receives a string current, and a chassis-grounded cathode;

a current source control unit which receives a driving current and outputs the string current to the at least one LED string, the current source control unit sense the driving current and compensates for the string current based on the sensed driving current and a reference voltage; and a voltage detector which detects a driving voltage and a string voltage of the anode to output a feedback voltage, wherein the driving voltage corresponds to the string voltage.

8. The backlight unit of claim 7, wherein a voltage difference between the driving voltage and the string voltage is maintained to be less than a predetermined value.

9. The backlight unit of claim 7, wherein when a voltage difference between the driving voltage and the string voltage is equal to or greater than a predetermined value, the driving current supplied to the at least one LED string is blocked.

10. The backlight unit of claim 7, further comprising:

a DC-to-DC converter which boosts an input source voltage to output a DC voltage and controls the DC voltage based on the feedback voltage, wherein the DC voltage corresponds to the driving voltage.

11. The backlight unit of claim 10, wherein a voltage difference between the DC voltage and the driving voltage is in a range from about 0.1 volt to about 0.5 volt.

12. The backlight unit of claim 10, wherein the DC-to-DC converter comprises an inductor booster which boosts the input source voltage to the DC voltage.

13. A backlight unit comprising:

a plurality of LED strings having an anode, which receives a string current, and a chassis-grounded cathode;

a DC-to-DC converter which boosts a source voltage to output a DC voltage;

a current feedback unit which receives the DC voltage to output a plurality of driving voltages and outputs a plurality of driving currents corresponding to the LED strings, respectively;

a current regulator which receives the driving voltages and the driving currents and outputs a plurality of string currents flowing in the LED strings, respectively, based on current control information; and an LED driving controller which senses the driving currents flowing in the current feedback unit to output the current control information to compensate for the string currents and controls the DC voltage based on relationships between the driving voltages and string voltages, wherein the string voltages are voltages at anodes of the LED strings, respectively.

14. The backlight unit of claim 13, wherein the LED driving controller is configured as an integrated circuit.

15. The backlight unit of claim 14, wherein the integrated circuit comprises:

a plurality of current source control units which senses the driving currents to output current compensation information for controlling the string currents;

a maximum value circuit which detects a maximum value among the string voltages and the driving voltage; and an output voltage control unit which receives an output of the maximum value circuit to output a feedback voltage.

16. The backlight unit of claim 15, wherein each of the current source control units comprises:

a first operational amplifier which outputs a voltage corresponding to a voltage difference between the DC voltage and the driving voltage;

a second operational amplifier which outputs a voltage corresponding to a voltage difference between the output value of the first operational amplifier and a reference voltage;

a third operational amplifier which outputs a voltage corresponding to a voltage difference between a divided voltage corresponding to the DC voltage and the string voltage; and a current balance control unit which outputs the reference voltage in response to a pulse width modulation signal.

17. The backlight unit of claim 13, wherein the current feedback unit comprises a plurality of sensing resistors, in which the driving currents flow.

18. The backlight unit of claim 17, wherein the current regulator comprises a plurality of metal-oxide-semiconductor (MOS) transistors having a gate which receives the current control information, and the MOS transistors receive the driving currents to output the string currents.

19. A current control method of a backlight unit, the current control method comprising:

sensing a driving current flowing in a hot side of each of a plurality of LED strings;

compensating for the driving current based on the sensed driving current and a reference voltage, the reference voltage corresponds to luminance of light emitted from the at least on LED string; and regulating a plurality of string currents respectively flowing in the LED strings based on the compensated driving current, wherein cathodes of the LED strings are chassis-grounded.

* * * * *